US011613841B2

(12) United States Patent
Kim et al.

(10) Patent No.: US 11,613,841 B2
(45) Date of Patent: Mar. 28, 2023

(54) LAUNDRY TREATING APPARATUS

(71) Applicant: LG Electronics Inc., Seoul (KR)

(72) Inventors: Jaehyung Kim, Seoul (KR); Semin Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 598 days.

(21) Appl. No.: 16/684,061

(22) Filed: Nov. 14, 2019

(65) Prior Publication Data

US 2020/0157732 A1 May 21, 2020

(30) Foreign Application Priority Data

Nov. 16, 2018 (KR) ..... 10-2018-0142083

(51) Int. Cl.

| | |
|---|---|
| ***D06F 87/00*** | (2006.01) |
| ***D06F 71/36*** | (2006.01) |
| ***D06F 71/40*** | (2006.01) |

(52) U.S. Cl.

CPC ..... *D06F 87/00* (2013.01); *D06F 71/36* (2013.01); *D06F 71/40* (2013.01)

(58) Field of Classification Search

CPC ..... D06F 87/00; D06F 71/34; D06F 71/36; D06F 71/40; D06F 67/00; D06F 73/02

USPC ..... D32/25

See application file for complete search history.

(56) References Cited

U.S. PATENT DOCUMENTS 1,016,515 A * 2/1912 Nolte ..... 16/256
2,235,573 A * 3/1941 Derman ..... E06B 5/006 312/297
5,014,453 A * 5/1991 Gratsch ..... D06F 71/00 38/14
5,815,961 A 10/1998 Estes et al.

(Continued)

FOREIGN PATENT DOCUMENTS

AU 2019203836 A 12/2019
CN 102449222 A 5/2012

(Continued)

OTHER PUBLICATIONS

European Search Report received from the European Patent Office (EPO) in European Patent Application No. 19209206.2, dated Feb. 25, 2020 (9 pages).

(Continued)

*Primary Examiner* — Ismael Izaguirre
(74) *Attorney, Agent, or Firm* — Birch, Stewart, Kolasch & Birch, LLP

(57) ABSTRACT

Disclosed herein is a laundry treating apparatus comprising a cabinet comprising an opening, a door rotatably coupled to the cabinet, an inner case disposed in the cabinet and configured to provide an accommodation space, a supply part configured to communicate with the inner case to supply at least one of air or moisture to the accommodation space, and a mount part disposed on at least one of the inner case or the door and configured to place the laundry in the accommodation space. The mount part comprises a support part disposed on at least one of the inner case or the door to support a surface of the laundry, and a pressing part. The pressing part comprises a pressing body rotatably coupled to one of the inner case, the door, or the support part, and a position change part and a position change part.

20 Claims, 11 Drawing Sheets

(56) References Cited

U.S. PATENT DOCUMENTS

| | | | | |
|---|---|---|---|---|
| 9,809,924 | B2 * | 11/2017 | Park | D06F 71/02 |
| 2004/0237356 | A1 | 12/2004 | Khasianovich | |
| 2015/0020419 | A1 * | 1/2015 | Park | D06F 71/30 38/3 |
| 2016/0208428 | A1 | 7/2016 | Razo | |
| 2016/0208429 | A1 | 7/2016 | Park et al. | |
| 2018/0135237 | A1 * | 5/2018 | Yoon | D06F 58/10 |

FOREIGN PATENT DOCUMENTS

| | | | |
|---|---|---|---|
| CN | 102753748 | A | 10/2012 |
| CN | 104294529 | A | 1/2015 |
| CN | 105714534 | A | 6/2016 |
| CN | 105714543 | A | 6/2016 |
| CN | 109891017 | A | 6/2019 |
| DE | 2646903 | A1 | 4/1978 |
| EP | 2826911 | A1 | 1/2015 |
| EP | 3034684 | A1 | 6/2016 |
| EP | 3321413 | A1 | 5/2018 |
| EP | 3 575 480 | A1 | 12/2019 |
| GB | 684681 | A | 12/1952 |
| JP | 4-126193 | A | 4/1992 |
| KR | 20-0391845 | Y1 | 8/2005 |
| KR | 10-2012-0091799 | | 8/2012 |
| KR | 10-2015-0065297 | A | 6/2015 |
| KR | 10-2018-0052956 | | 5/2018 |
| KR | 10-2018-0094822 | A | 8/2018 |
| RU | 2014116894 | A | 11/2015 |
| WO | WO 2018/088833 | A1 | 5/2018 |

OTHER PUBLICATIONS

International Search Report received from the Korean Intellectual Property Office (KIPO) in PCT Patent Application No. PCT/KR2019/015527, dated Mar. 4, 2020 (9 pages).

Notice of Allowance in Russian Application No. 2021113540/03(028665), dated Dec. 10, 2021, (19 pages).

Office Action in Korean Application No. 10-2021-0100057, dated Sep. 15, 2021, (9 pages).

Office Action in Chinese Application No. 201911118596.4, dated Nov. 2, 2021 (16 pages).

* cited by examiner

LAUNDRY TREATING APPARATUS

CROSS-REFERENCED TO RELATED APPLICATIONS

This application claims the benefit of priority under 35 U.S.C. § 119(a) to Korean Patent Application No. 10-2018-0142083, filed on Nov. 16, 2018, the disclosure of which is hereby incorporated by reference in its entirety.

BACKGROUND

Technical Field

The present disclosure relates to a laundry treating apparatus.

Discussion of the Related Art

In general, a laundry treating apparatus is a device that performs various operations related to laundry (washing, drying, deodorization, wrinkle removal, etc.). It is a concept including a laundry machine configured to wash laundry, a dryer configured to dry wet laundry, and a refresher configured to remove odors or wrinkles from laundry.

It is a recent trend to develop a laundry treating apparatus as a single device capable of addressing washing, drying, deodorization and wrinkle removal of the laundry. However, since such a laundry treating apparatus operates based on a drum in which laundry are accommodated and a driving device configured to rotate the drum, its function of removing odors or wrinkles from the laundry may be unsatisfactory.

In order to address this issue, a laundry treating apparatus from Korean Patent Application Publication No. 10-2013-0150441 has been introduced. FIG. 1 shows a configuration of the aforementioned laundry treating apparatus.

Referring to FIG. 1, the laundry treating apparatus includes a cabinet 100 defining an exterior, an inner case 200 configured to provide an accommodation space for accommodating laundry, a door 30 configured to open and close the cabinet, a mount part 400, 500 provided on the door or the inner case to hang a laundry thereon, a support part 540 arranged below the mount part to support the surface of the laundry, a pressing part 600 rotatably arranged on a side of the support part 540 to press the laundry hung on the mount part, and a supply part 700 configured to supply hot air or moisture to the inner case 200.

Thus, the laundry treating apparatus may supply hot air through the supply part disposed at a lower portion of the cabinet or press the laundry with the laundry placed in the accommodation space inside the cabinet, thereby removing odors and wrinkles at the same time.

In addition, the laundry treating apparatus may stretch out laundry that has been dried and deodorized or unwrinkled by gravity and by supplying hot air or moisture. In addition, as the surface of the laundry is pressed with the pressing part, wrinkles may be effectively removed from the laundry or creases (predetermined wrinkles) may be formed on the laundry. Thereby, ironing may be skipped after washing or drying is completed.

In the case of the conventional laundry treating apparatus, the pressing part 600 presses the laundry P by turning from a side of the laundry P. Accordingly, the pressing part 600 sequentially presses the laundry P from one side to the other side of the laundry P.

As a result, a portion of the laundry P positioned relatively close to the pressing part 600 is subjected to relatively high pressure, while a portion of the laundry P positioned relatively far from the pressing part 600 is subjected to relatively low pressure. Accordingly, the laundry is not evenly pressed.

Furthermore, when the laundry P is pressed by the pressing part 600, the laundry P is pushed away and is thus disordered or displaced.

In addition, the conventional laundry treating apparatus may not fix the laundry P even when the laundry P is hung on the mount part. Accordingly, it may fail to prevent the laundry P from being displaced.

Thus, in the case of the conventional laundry treating apparatus, the pressing part 600 may form more wrinkles on the laundry P or generate completely unintended creases.

In addition, as the pressing part 600 is arranged to rotate widthwise, it tends to press only a specific area of the laundry P.

Further, the conventional laundry treating apparatus may lower convenience because the pressing part rotates only in one direction to leave the portion of the laundry that is hung open, and is not allowed to rotate in other directions.

Moreover, the conventional laundry treating apparatus has a structural limitation because the pressing part is not allowed to move up or down or move toward the front of the laundry while being positioned parallel to the laundry.

SUMMARY OF THE DISCLOSURE

Accordingly, the present disclosure is directed to a laundry treating apparatus that substantially obviates one or more problems due to limitations and disadvantages of the related art.

An object of the present disclosure is to provide a laundry treating apparatus capable of preventing clothing from being disorderly arranged or the position or shape thereof from being changed in the process of pressing the clothing.

Another object of the present disclosure is to provide a laundry treating apparatus capable of evenly pressing the surface of clothing by applying pressure to the front of the clothing.

Another object of the present disclosure is to provide a laundry treating apparatus having a pressing part configured to press clothing and capable of slidably moving toward the front of the clothing while rotating on one surface on which the clothing is placed.

Another object of the present disclosure is to provide a laundry treating apparatus capable of evenly pressing the surface of clothing while a pressing part moves up or down.

Another object of the present disclosure is to provide a laundry treating apparatus that may maximize user convenience by allowing a pressing part configured to press clothing to selectively rotating to both sides.

Another object of the present disclosure is to provide a laundry treating apparatus capable of preventing a pressing part configured to press clothing from being completely separated while rotating and moving.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these objects and other advantages and in accordance with the purpose of the disclosure, as embodied and broadly described herein, a laundry treating apparatus may comprise a cabinet comprising an opening, a door rotatably coupled to the cabinet and configured to open and close the opening, an inner case disposed in the cabinet and configured to provide an accommodation space to accommodate laundry, a supply part configured to communicate with the inner case to supply at least one of air or moisture to the accommodation space, and a mount part disposed on at least one of the inner case or the door and configured to place the laundry in the accommodation space.

The mount part may comprise a support part disposed on at least one of the inner case or the door to support a surface of the laundry, and a pressing part coupled to at least one of the inner case or the door and configured to rotate toward the support part to press the laundry.

The pressing part may comprise a pressing body rotatably coupled to at least one of the inner case or the door so as to face the support part while being spaced apart from the support part by a predetermined distance, and a position change part configured to bring the pressing body into close contact with the support part when the pressing body is positioned facing the support part.

The pressing part may further comprise a fixing hinge disposed on one of the inner case or the door and configured to rotate the pressing body to a position where the pressing body is spaced apart from the support part while facing the support part.

The position change part may be coupled to the fixing hinge to move the pressing body toward the support part while the pressing body is positioned facing the support part.

The position change part may further comprise a body coupling part connected to the fixing hinge and coupled to the pressing body, and a body moving part coupled to the body coupling part and configured to move the pressing body toward the support part or move the pressing body and the body coupling part toward the support part simultaneously.

The body moving part may comprise a radial rotation part coupled to the fixing hinge and configured to rotate the body coupling part in a direction parallel to a height direction of the support part to move the pressing body toward the support part.

The radial rotation part may comprise a movement groove formed in the fixing hinge in the height direction of the support part, and a rotation coupling pin coupled to one end of the movement groove and configured to rotatably couple to one end of the body coupling part.

The body coupling part may be fixed to the fixing hinge, wherein the body moving part may be arranged inside the pressing body and configured to allow the pressing body to slidably move on the body coupling part.

The body coupling part may further comprise an extension part extending from the fixing hinge, a coupling hook protruding from one side or both sides of the extension part, and a body fixing part arranged inside the pressing body and coupled to the coupling hook, wherein the body moving part may further comprise a sliding part coupled to the body fixing part and configured to allow the coupling hook to move.

The sliding part may further comprise a sliding groove extending from the body fixing part configured to allow the coupling hook to reciprocate therethrough, wherein the sliding groove is inclined to allow the pressing body to press the support part by moving downward.

The body moving part may further comprise a stopper protruding from an inner circumferential surface of the sliding groove and configured to allow the coupling hook to remain fixed at one end or both ends of the sliding groove.

The fixing hinge may include a fixing bar connected to the body coupling part and configured to rotate the pressing body, and a fastening part rotatably coupled to the fixing bar on the door or the support part and configured to support the pressing body.

The fixing hinge may be disposed on both sides of the pressing body and configured to allow one surface of the pressing body to be pressed while spacing is maintained between the one surface and the support part.

The fixing bar may be disposed on both sides of the pressing body, wherein the fastening part may comprise a plurality of fastening parts coupled to the support part or the door, wherein each of the fastening parts may be detachably coupled to each of the fixing bars.

The fixing hinge may be configured to allow the fixing bar to be separated from the fastening part when the pressing body is positioned facing the support part, and to prevent the fixing bar from being separated from the fastening part when the pressing body is rotated away from the support part.

The fastening part may comprise a fastening body configured to accommodate the fixing bar, a fastening groove configured to allow the fixing bar to be inserted into and withdrawn from the fastening body, and a catching part protruding from an inner circumferential surface of the fastening groove and configured to prevent the fixing bar from being separated, wherein the fixing bar may comprise a fixing body accommodated in the fastening body, and a step body coupled to the fixing body in a stepped manner and separable from the catching part.

The fixing bar may further comprise a release rib extending from the fixing body and configured to rotate the step body, wherein the pressing body may further comprise a rotatable installation part configured to press the release rib.

The rotatable installation part may include a handle body rotatably arranged in the pressing body, a handle rotation pin configured to rotatably couple the handle body to the pressing body, and a rib contact bar extending from the handle rotation pin and configured to press the release rib.

The step body may be coupled to one or both ends of the fixed body and configured to axially rotate on the fixing body, wherein the release rib may extend from the step body.

The step body, the fixing body, and the release rib may be integrally formed, wherein the body coupling part may comprise an extension part extending from the fixing hinge, and a coupling hook protruding from one side or both sides of the extension part, wherein the pressing body may further comprise a body fixing part coupled to the body coupling part and configured to allow the body coupling part to rotate in an axial direction of the fixing body.

The body fixing part may comprise a rotation bar disposed inside the pressing body and configured to guide movement of a free end of the coupling hook, a fixing rib disposed on both sides of the rotation bar and configured to guide movement of the rotation bar, an anti-separation part coupled to one end of the rotation bar and configured to prevent the coupling hook from being separated, and a stop rib coupled to an opposite end of the rotation bar and configured to limit movement of the coupling hook.

The pressing body may further comprise a rotatable installation part coupled to the fixing hinge, wherein the rotatable installation part may comprise an installation groove configured to allow the pressing body to move upward or downward on the fixing hinge, wherein the installation groove is longer than the fixing hinge.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION OF THE DISCLOSURE

Figure 1:
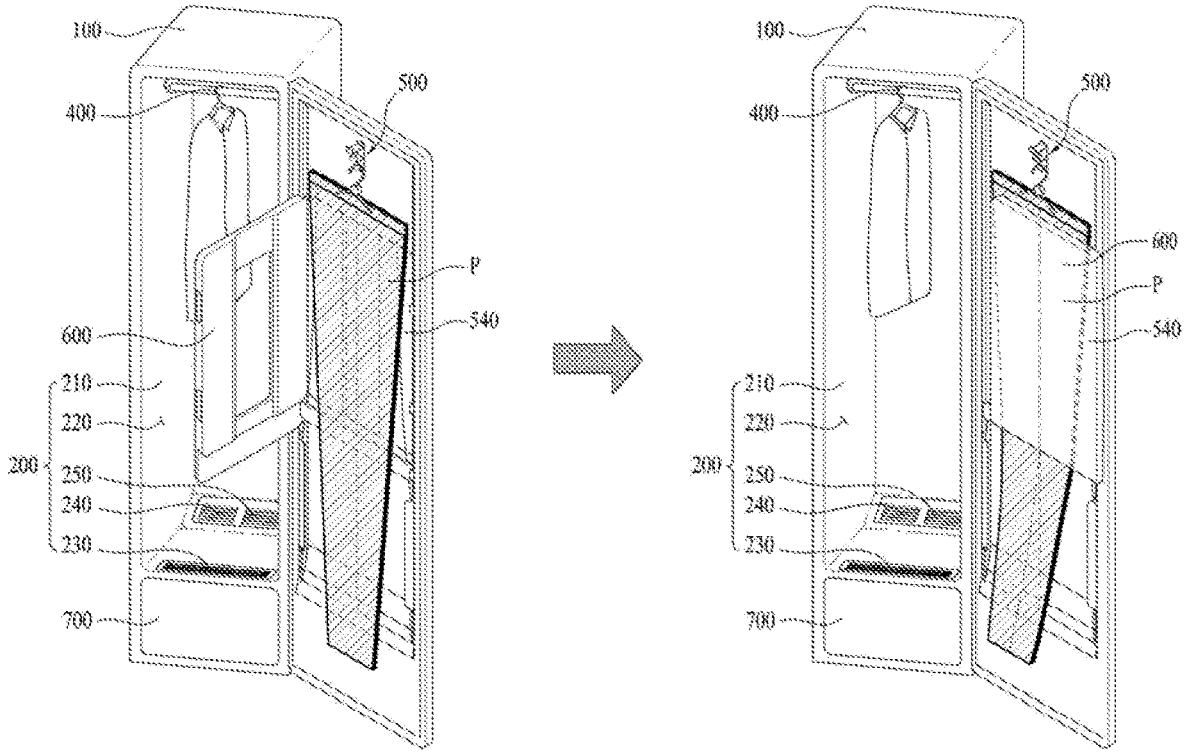
FIG. 1 shows a structure of a conventional laundry treating apparatus.

Reference will now be made in detail to the preferred embodiments of the present disclosure, examples of which are illustrated in the accompanying drawings. Wherever possible, the same reference numbers will be used throughout the drawings to refer to the same or like parts.

Hereinafter, exemplary embodiments disclosed herein will be described in detail with reference to the accompanying drawings. In the present specification, the same or similar reference numerals are assigned to the same or similar elements in different embodiments, and each of them will be described only once. As used herein, the singular forms "a", "an" and "the" include plural forms unless the context clearly indicates otherwise. In addition, in describing the embodiments disclosed herein, when it is determined that the detailed description of the related known technology may obscure the gist of the embodiments, the detailed description thereof will be omitted. In addition, it should be noted that the accompanying drawings are merely provided to facilitate understanding of the embodiments disclosed in the present specification and are not to be construed as limiting the technical spirit disclosed in the present specification.

Figure 2:
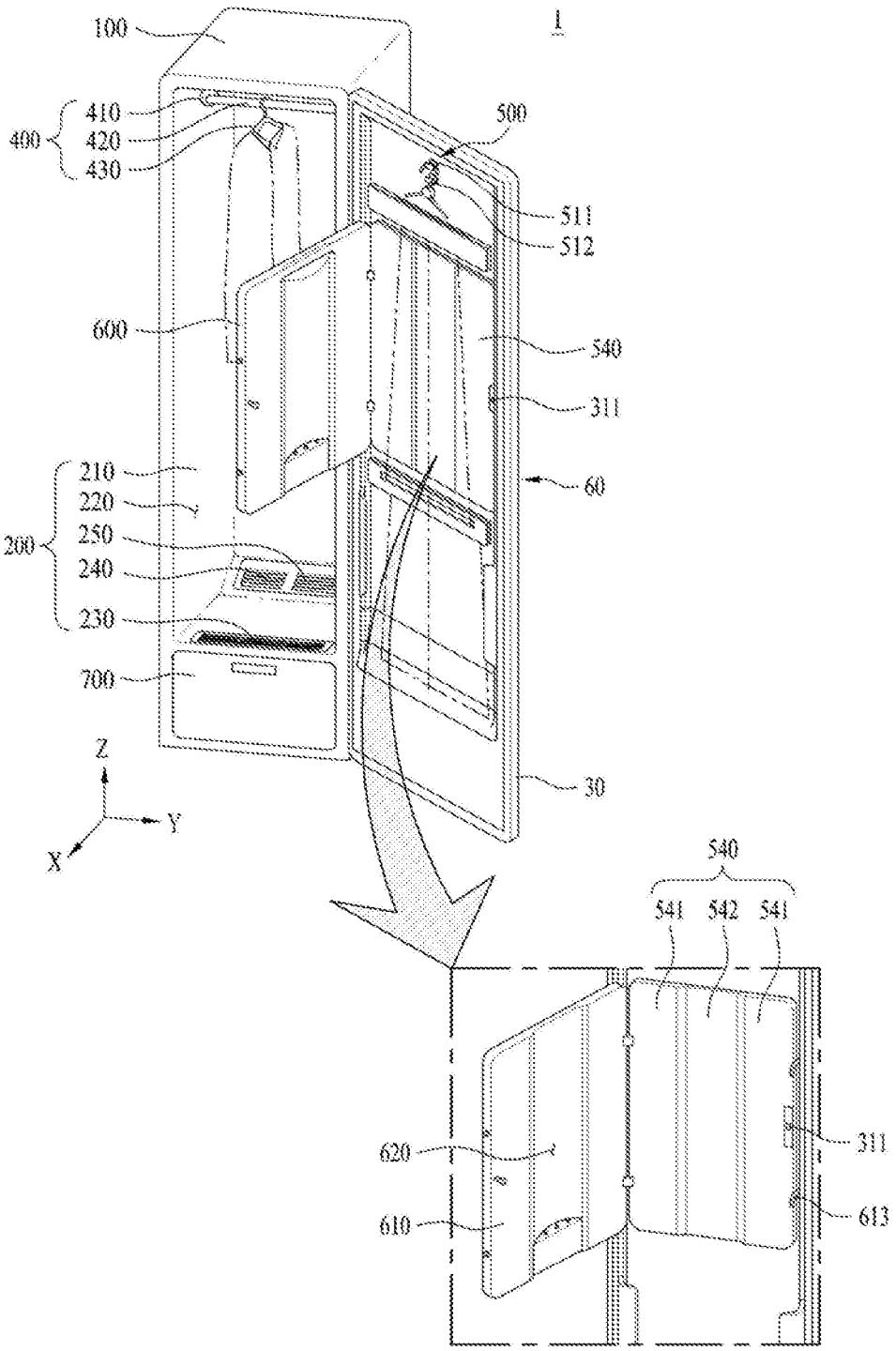
FIG. 2 shows a structure of a laundry treating apparatus according to an embodiment of the present disclosure.

FIG. 2 shows a laundry treating apparatus 1 according to an embodiment of the present disclosure.

Referring to FIG. 2, the laundry treating apparatus of the present disclosure may comprise a cabinet 100 having an opening in the front thereof, a door 30 rotatably provided to the cabinet 100 to open and close the opening, an inner case 200 provided in the cabinet to provide an accommodation space 220 in which laundry P may be accommodated, a supply part 700 configured to communicate with the inner case 200 to supply at least one of air or moisture to the accommodation space, mount parts 400, 500 provided to at least one of the inner case 200 or the door 30 to place or fix the laundry P in the accommodation space.

The cabinet 100 may be provided to define the exterior of the laundry treating apparatus, and may have a height greater than a width. As a result, even laundry P, such as long pants, may be accommodated in the accommodation space 220 without being folded. Accordingly, wrinkles may be prevented from being formed on the laundry P.

The cabinet 100 may be formed of a metal material. It may be formed of a resin material such as reinforced plastic as long as it is capable of maintaining strength.

The inner case 200 may further comprise an inner body 210 positioned in the cabinet 100 to define the accommodation space 220. The inner body 210 may be formed of a material that is robust to be capable of maintaining strength without being deformed or making a chemical reaction by foreign matter discharged from the laundry P or hot air or moisture supplied from the supply part, or without. For example, the material for the inner body may comprise a styrene resin, such as acrylonitrile butadiene sytrene (ABS) or acrylonitrile styrene acrylate (ASA).

The inner body 210 may be configured to communicate with the supply part 700 on one surface thereof to receive hot air or moisture from the supply part 700 or to discharge air to the supply part 700. To this end, the inner body 210 may comprise a plurality of through-holes 230, 240, and 250 communicating with the supply part 700.

The cabinet 100 may further comprise a supply part 700 separated from the accommodation space 220. The supply part 700 may be provided in a lower portion of the accommodation space 220 to supply heated air or steam having a relatively lower density than air.

That is, when the air supplied to the accommodation space 220 by the supply part is heated air (hot air), and the moisture supplied to the accommodation space by the supply part is steam, hot air or steam may be evenly supplied into the accommodation space 220 without a separate blower as long as the supply part 700 is positioned in the lower portion of the accommodation space 220.

The door 30 may be rotatably coupled to the cabinet 100 to open and close the opening. The door 30 may be configured to shield not only the inner body 210 but also the front of the supply part 700. As a result, the hot air or the moisture supplied to the accommodation space 220 may be prevented from leaking to the outside, and the heat generated by the supply part 700 may be blocked from being transferred to the outside.

Since the door 30 may be arranged to open and close the front of the inner body 210, the inner peripheral surface of the inner body 210 and the inner surface of the door 30 may form an outer peripheral surface of the accommodation space 220.

The mount part may comprise a first mount part 400 provided in the inner body 210 to place the laundry P in the accommodation space 220, and a second mount part 500 provided to place the laundry P on an inner surface of the inner body 210 or the door 30.

That is, the first mount part 400 may be provided in a hanger shape or a bar shape in the inner body 210 such that the laundry P may be evenly exposed in the accommodation space 220. The second mount part 500 may be formed such that the laundry P may be attached and fixed to the inner peripheral surface (surface) of the inner body 210 or the inner surface of the door 30.

The first mount part 400 may be provided on the top surface of the inner body 210 or an upper portion of the inner body 210 such that the laundry P may be placed in the accommodation space 220 in a fully stretched state without being folded.

Accordingly, the first mount part 400 may allow the laundry P to be placed in the accommodation space 220 while being stretched by its own weight, and thus the laundry P may be evenly exposed to the air or moisture supplied from the supply part 700.

The second mount part 500 may allow the laundry P to be fixed while being attached to the inner peripheral surface of the accommodation space 220. As a result, the second mount part 500 may allow wrinkles to be actively removed from the laundry P or creases to be actively formed on the laundry P.

Specifically, the second mount part 500 may comprise a support part 540 coupled to the inner surface of at least one of the inner case 210 or the door 30 to support one surface of the laundry P, and a pressing part 600 coupled to at least one of the inner case, the support part 54 or the door 30 so as to be rotatable toward the support part 540 to press the laundry.

When the pressing part 600 presses the laundry P, the support part 540 may serve to press a surface of the laundry P that does not contact one surface of the pressing part 600. That is, the support part 540 may be arranged under a fixing part 510 to support or contact the surface of the laundry P.

Specifically, the support part 540 may comprise a support plate 541 formed in a plate shape to press the laundry P when the pressing part 600 applies pressure. The support plate 541 may apply a reaction to the pressure of the pressing part 600 to the laundry P.

The support part 540 may further comprise a spacing groove 542 provided in between the support plates 541 to provide a space for preventing the laundry P from being pressed. The spacing groove 542 may provide elasticity of the support plate 541, to improve close contact between the support plate 541 and the pressing part 600. In addition, when the laundry P comprises pants, the spacing groove 542 may prevent unnecessary wrinkles from being formed on the surface of the laundry P by pressing of the seam provided in the pants.

The pressing part 600 may comprise a pressing body 610 rotatably coupled to at least one of the inner case or the door to press the laundry P.

The pressing body 610 may be formed in the shape of a plate having a predetermined thickness to press the support plate 541.

The pressing part 600 may further comprise a body through-hole 620 formed through the pressing body 610 to allow the laundry P to communicate with the accommodation space.

The body through-hole 620 may have a length greater than a width thereof and be provided such that the spacing groove 542 is exposed to the outside. As a result, the laundry P may be prevented from forming unnecessary wrinkles by the seam. In addition, the body through-hole 620 may allow air or steam to be continuously exposed to the laundry P even when the pressing body 610 presses the laundry P.

Even when the pressing part 600 is rotatably arranged on one side of the support part 540, the laundry treating apparatus 100 may cause the pressing part 600 to contact and press the whole parts of the surface of the laundry at the same time, thereby preventing the laundry from being misaligned.

Figure 3A:
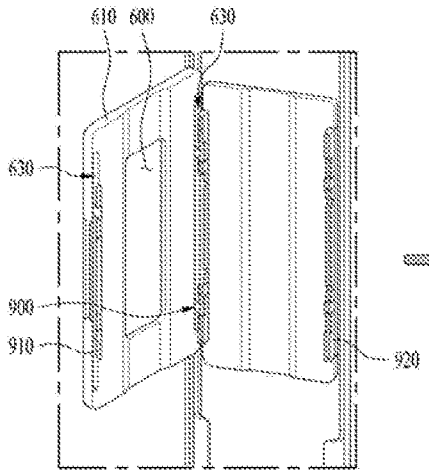
FIG. 3A illustrates the function of a pressing part configured to press laundry according to an embodiment of the present disclosure.
Figure 3B:
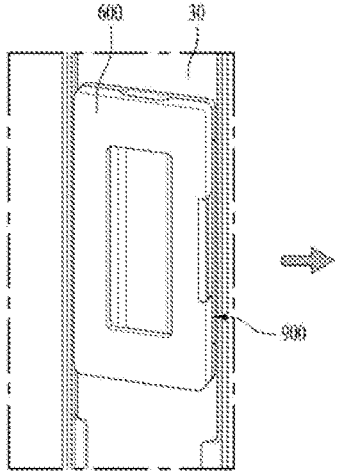
FIG. 3B illustrates the function of the pressing part of FIG. 3A configured to press laundry according to an embodiment of the present disclosure.
Figure 3C:
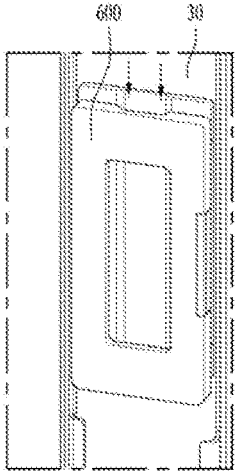
FIG. 3C illustrates the function of the pressing part of FIG. 3A configured to press laundry according to an embodiment of the present disclosure.

FIGS. 3A-3C illustrate a structure allowing the pressing part 600 of the laundry treating apparatus to be positioned parallel to the surface of the laundry to contact and press the surface of the laundry.

Referring to FIG. 3A, the pressing part 600 may further comprise a fixing hinge 900 provided to one of the inner case, the support part 540 or the door 30 to rotate the pressing body 610.

The pressing part 600 may further comprise a rotatable installation part 630 that may be coupled to the fixing hinge 900.

Referring to FIG. 3B, the fixing hinge 900 may rotate the pressing body 610 to a position where the support body 610 may face the support part 540 while being spaced apart from the support part 540. That is, the fixing hinge 900 may allow the pressing body 610 to rotate until the pressing body 610 is positioned parallel to the support part 540.

Therefore, the pressing body 610 may rotate until it is arranged parallel to the support part 540 by the fixing hinge 900.

When laundry P is placed on the support part 540, the pressing body 610 may be rotated toward the laundry P by the fixing hinge 900, and may be fixed at the position at which the pressing body 610 faces the surface of the laundry P. At this position, the pressing body 610 may not contact the laundry P. Even when the pressing body 610 contacts the laundry P, the laundry P may not be pressed.

Referring to FIG. 3C, the laundry treating apparatus 100 may further comprise a position change part capable of positioning the pressing body 610 close to the support part 540 when the pressing body 610 faces the support part 540. The detailed structure of the position change part will be described later.

The pressing body 610 may move toward the support part 540 while being moved downward by the position change part.

That is, when arranged facing the support part 540, the pressing body 610 may slidably or rotatably move toward the support part 540 to move to a position where spacing between the pressing body 610 and the support part 540 is uniformly maintained. Thereby, the pressing body 610 may evenly press the surface of the laundry P.

Figure 4A:
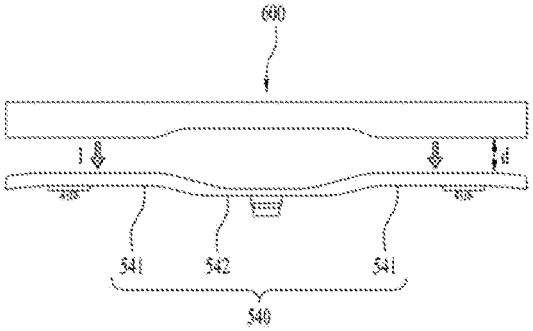
FIG. 4A illustrates an example in which the pressing part presses laundry according to an embodiment of the present disclosure.
Figure 4B:
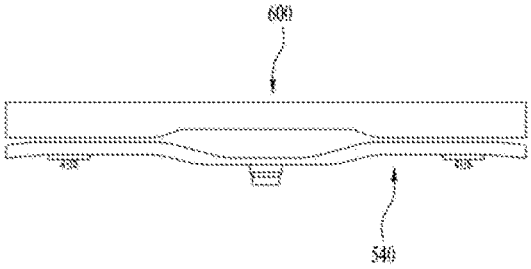
FIG. 4B illustrates an example in which the pressing part of FIG. 4A presses laundry according to an embodiment of the present disclosure

FIGS. 4A-4B show cross-sectional views of the pressing part 600 and the support part 540.

Referring to FIG. 4A, when the pressing part 600 rotates in a direction from one side of the laundry P to the other side of the laundry P, the pressing part 600 may not rotate up to a position where the laundry P is pressed, but may rotate to a position where the pressing part 600 is spaced apart from the front surface of the laundry P. That is, when the rotation of the pressing body 610 is completed, the pressing body 610 and the support part 540 may be spaced apart from each other by a predetermined distance p.

In this state, the pressing part 600 may move in direction I by moving from a higher position to a lower position.

Referring to FIG. 4B, the pressing part 600 may move until it comes into contact with the support part 540, and may press the front of the laundry P.

When the pressing part 600 applies pressure by moving downward from above the laundry P, the pressure may be applied to the laundry P in the same direction as the weight of the laundry P. Accordingly, the laundry P may be prevented from being misaligned or displaced.

In addition, since the pressing part 600 may press the laundry P while evenly contacting one surface of the laundry P, the position of the laundry P may be prevented from being changed when the laundry P comes into contact with the pressing part 600.

As a result, the laundry treating apparatus 10 may prevent undesired wrinkles or creases from being formed when the laundry P is mount parted on the fixing part 510 or the support part 540.

In other words, the pressing part 600 may be rotated on the support part 540 due to the fixing hinge 900, and may be moved evenly toward the support part 540 due to the position change part 800 while facing the support part 540.

Alternatively, the pressing body 610 may be moved from a lower position to an upper position by the position change part 800 to press the laundry.

Figure 5:
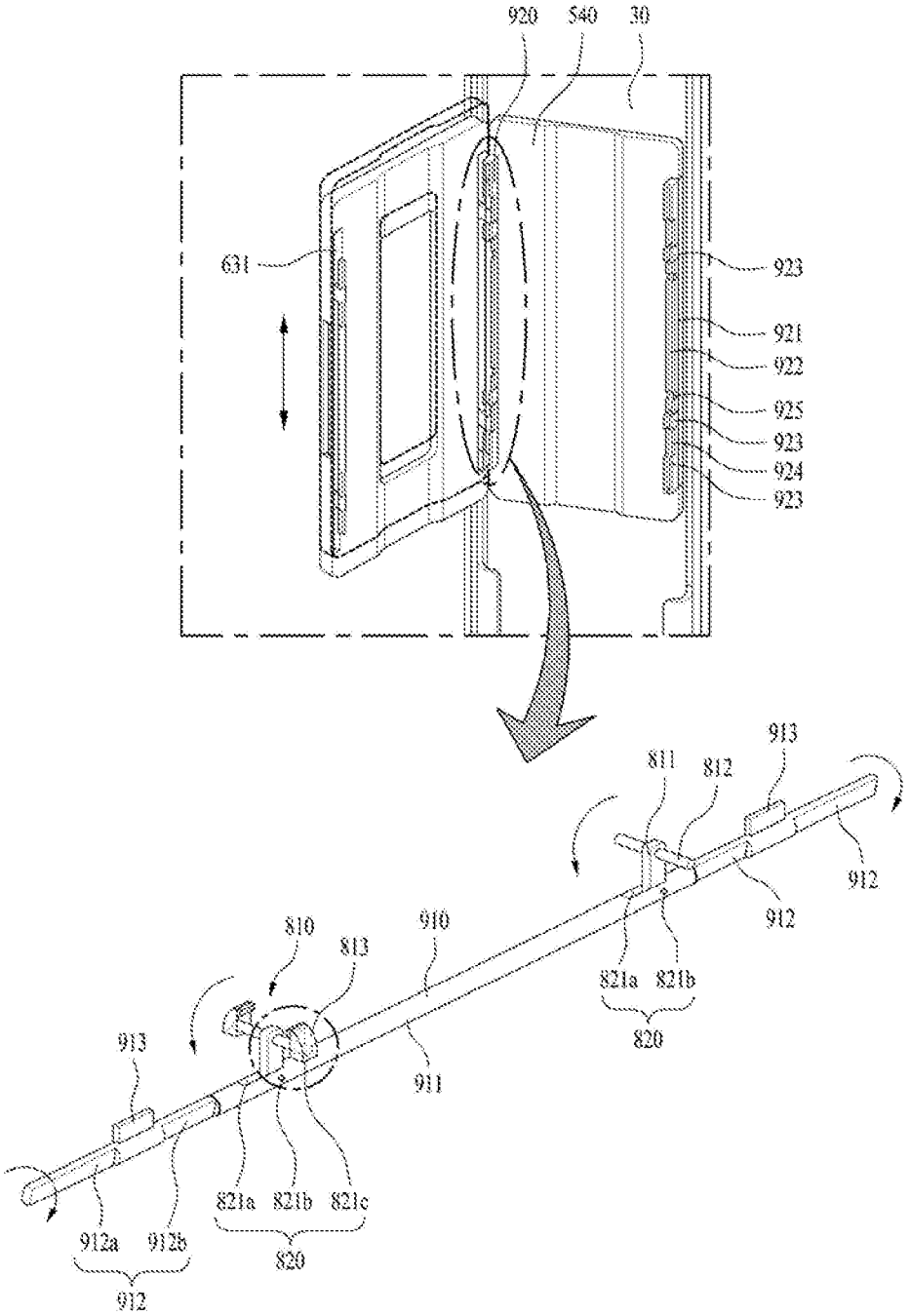
FIG. 5 illustrates an example of a position change part allowing the pressing part to press laundry according to an embodiment of the present disclosure.

FIG. 5 illustrates an example of the position change part and the fixing hinge of the laundry treating apparatus according to an embodiment of the present disclosure.

Referring to FIG. 5, the fixing hinge 900 may comprise a fixing bar 910 coupled to one side or both sides of the pressing body 610 to rotatably couple the pressing body 610 on the support part 540 or to fix the position of the pressing body 610, and a fastening part 920 provided to the door 30 or the support part 540 so as to be coupled to the fixing bar 910.

The fixing hinges 900 may be provided on both sides of the pressing body 610. One fixing hinge 900 may form the center of rotation of the pressing body 610, and the other fixing hinge 900 may be configured to fix the position of the pressing body 610.

The fixing bar 910 may be formed in a tubular or rod shape, and may protrude outward from both sides of the pressing body 610 so as to be coupled. The fastening part 920 may be configured to be coupled to the fixing bar 910 by accommodating the fixing bar 910, and the fixing bar 910 may be detachably provided thereto. In addition, the fastening part 920 may allow the fixing bar 910 to rotate, and may form a center of rotation around which the pressing body 610 rotates.

The fastening part 920 may comprise a fastening body 921 configured to accommodate the fixing bar 910, a fastening groove 922 provided in the fastening body 921 to allow the fixing bar to be inserted thereinto, and a catching part 923 protruding from the inner circumferential surface of the fastening groove 922 to prevent the fixing bar 910 from being separated.

The catching part 923 may extend from the fastening groove 922 and protrude in parallel with the fastening body 921. The catching part 923 may be formed in a hook shape.

At least one catching part 923 may be provided only in a portion of the inner circumferential surface of the fastening body 921 such that the inside of the fastening groove 922 may be exposed to the outside.

The fixing bar 910 may comprise a fixing body 911 arranged to be accommodated in the fastening body 921, and a step body 912 provided to the fixing body 911 in a stepped manner so as to be separable from the catching part.

The fixing body 911 may have a circular cross section, and the step body 912 may have a track-shaped cross section. Specifically, the left and right surfaces of the step body 912 may have a shape corresponding to that of the fixing body 911, and the upper and lower surfaces thereof may be narrower than the diameter of the fixing body 911.

That is, the step body 912 may be divided into a thick portion having the same thickness as the fixing body 911 and a thin portion having a thickness less than that of the fixing body 911.

The step body 912 may be provided at one end or both ends of the fixing body 911. At least one step body 912 may be arranged inside the fixing body 911. The step body 912 may comprise a first step body 912*a* provided at both ends of the fixing body 911 and a second step body 912*b* spaced apart from the first step body 912*a* by a predetermined distance.

The position change part 800 may comprise a body coupling part 810 connected to the fixing hinge 900 and coupled to the pressing body 610, and a body moving part 820 coupled to the body coupling part 810 to move the pressing body 610 toward the support part or to move the pressing body 610 and the body coupling part 810 toward the support part at the same time.

A plurality of body coupling parts 810 may be provided to the fixing hinge 900 and arranged in the height direction of the pressing body 610. As a result, the body coupling parts 810 may prevent the pressing body 610 from tilting.

The body coupling part 810 may comprise an extension part 811 coupled to the fixing bar 910 and a coupling hook 812 protruding from one side or both sides of the extension part 811. The extension part 811 may be provided in a rod shape, and one end thereof may be coupled to the fixing bar 910. The coupling hook 812 may be integrated with the extension part 811 or may be provided as a separate member from the extension part 811 and coupled to the extension part 811. The coupling hook 812 may be coupled to the opposite end of the extension part 811 so as to be coupled to the pressing body 610.

The body coupling part 810 may further comprise a body fixing part 813 arranged inside the pressing body 610 to couple the coupling hook 812 and the pressing body 610.

The fixing bar 910 may be arranged on one surface of the pressing body 610 and may be coupled to the pressing body 610 through the body coupling part 810. In this case, the pressing body 610 may be spaced apart from the fixing bar 910 by a distance corresponding to the length of the extension portion 811.

The rotatable installation part 630 provided to the pressing body 610 may comprise an installation groove 631 formed in both side surfaces of the pressing body 610 to allow the extension part 811 to be coupled therethrough.

The body moving part 820 may comprise a radial rotation part 821 provided to the fixing hinge 900 to rotate the body coupling part 810 in a direction parallel to the height direction of the support part 540 to move the pressing body 610 toward the support part 540.

The radial rotation part 821 may comprise a movement groove 821*a* formed in the fixing hinge 900 in the height direction of the support part 540, and a rotation coupling pin 821*b* provided to one end of the movement groove 821*a* to rotatably couple one end of the body coupling part 810. The movement groove 821*a* may be concavely formed at one side of the fixing body 911, or may be formed through the fixing body 911 in a penetrating manner. The movement groove 821*a* may be arranged in a longitudinal direction of the fixing body 911. The rotation coupling pin 821*b* may be coupled to one end of the movement groove 821*a* by passing through one end of the extension part 811. As a result, the body coupling part 810 may rotate around the rotation coupling pin 821*b*.

The opposite end of the extension part 811 may be rotatably provided in the pressing body 610 by the body fixing part 813. A plurality of extension parts 811 may be arranged in the height direction of the fixing bar 910. Therefore, the pressing body 610 coupled to the plurality of body coupling parts 810 may not rotate, but may make planar movement or sliding movement while remaining parallel to the fixing hinge 900.

Specifically, when the extension part 811 is rotated to the opposite end of the movement groove 821*a*, the pressing body 610 may move toward the fixing hinge 900. When the extension part 811 is rotated away from the opposite end of the movement groove 821*a*, the pressing body 610 may move away from the fixing hinge 900.

When the extension part 811 is coupled to the upper end of the movement groove 821*a*, the extension part 811 may rotate from an upper side to a lower side. Accordingly, the pressing body 610 may be positioned close to the support part 540 as it moves from the upper side to the lower side. When the extension part 811 is coupled to the lower end of the movement groove 821*a*, the extension part 811 may rotate from a lower side to an upper side. Accordingly, the pressing body 610 may come close to the support part 540 as it moves from the lower side to the upper side.

Since it is advantageous to press the support part 540 using the load of the pressing body 610, the extension part 811 may be coupled to the upper end of the movement groove 821*a*. Of course, the extension part 811 may be arranged between the upper end and the lower end of the movement groove 821*a*. Thus, the pressing body 610 may be arranged to come close to the support part 540 by moving upward or downward.

To this end, the installation groove 631 may be formed to be longer than the fixing bar 910. For example, the pressing body 610 may be formed to be longer than the fixing bar 910 by a distance that may be moved by the extension part 811.

Figure 6A:
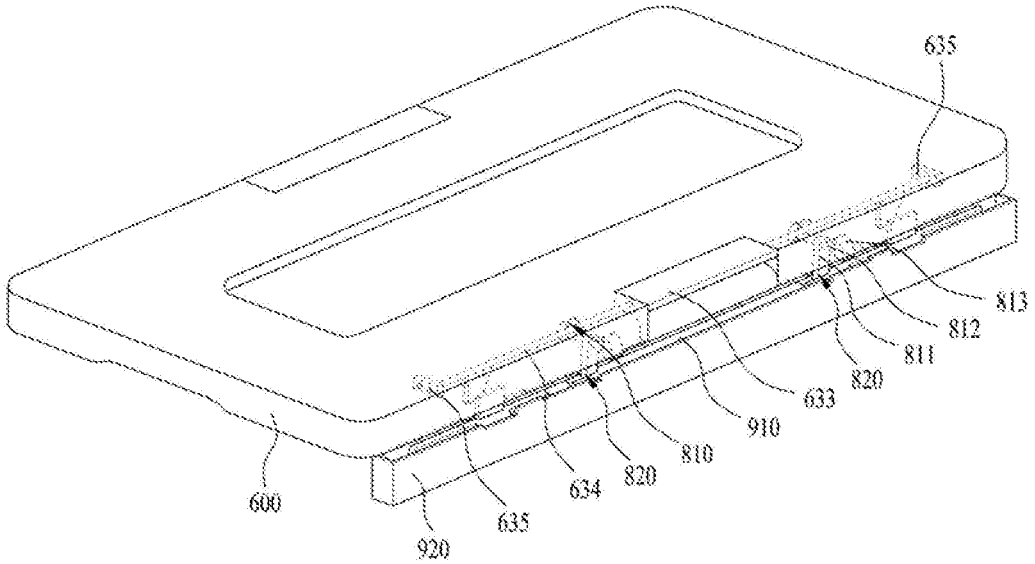
FIG. 6A illustrates operation of the position change part shown in FIG. 5 according to an embodiment of the present disclosure.
Figure 6B:
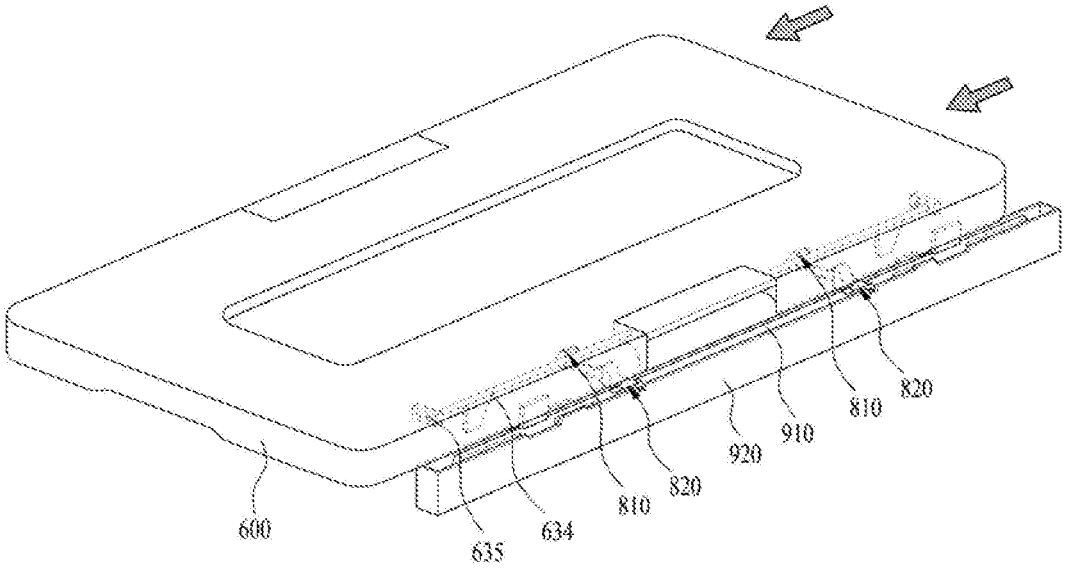
FIG. 6B illustrates operation of the position change part shown in FIG. 5 according to an embodiment of the present disclosure.

FIGS. 6A-6B illustrate an aspect in which the pressing body 610 presses the support part 540 through the position change part 800.

Referring to FIG. 6A, when the pressing body 610 rotates toward the support part 540 through the fixing hinge 900 provided at one side thereof, the fixing bar 910 provided at the opposite side may be coupled to the fastening part 920. In this case, when the fixing bar 910 and the fastening part 920 provided on both sides have the same fastening height, the pressing body 610 may be disposed parallel to the front surface of the support part 540.

In this case, since the fixing bar 910 protrudes to one surface of the pressing body 610, the pressing body 610 may be spaced apart from the supporting portion 540 by the length of the body fastening part 810.

Referring to FIG. 6B, the pressing body 610 may be slidably moved toward the fixing hinge 900 by the radial rotation part 821. Specifically, the plurality of extension parts 811 provided to the fixing hinge 900 on both sides may be rotated on the fixing bar 910 by the rotation coupling pins 821*b*. Thereby, the pressing body 610 coupled to the plurality of extension parts 811 may move downward and toward the support part 540 while being arranged parallel to the support part 540.

As a result, when there is laundry P mount parted on the support part 540, the pressing body 610 may evenly press the surface of the laundry P while being arranged parallel to the support part 540.

Thus, the user may completely open the pressing body 610 from the support part 540 and mount part the laundry on the support part 540. In addition, the pressing body 610 may be positioned spaced apart from the support part 540 by a predetermined distance, then may be brought into uniform contact with the surface of the laundry.

Figure 7A:
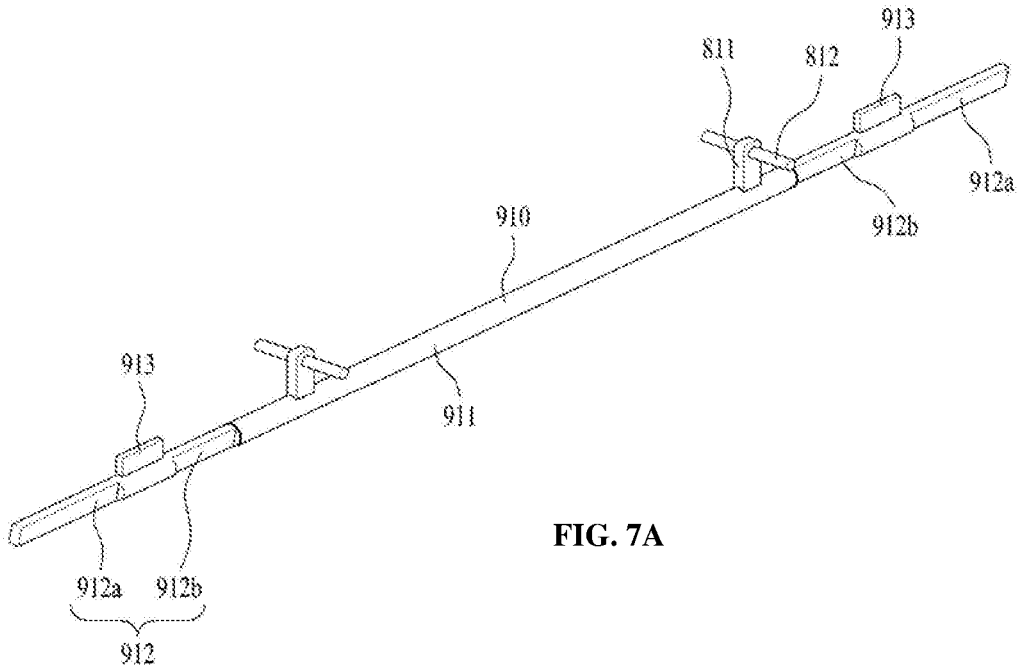
FIG. 7A illustrates another example of the position change part according to an embodiment of the present disclosure.
Figure 7B:
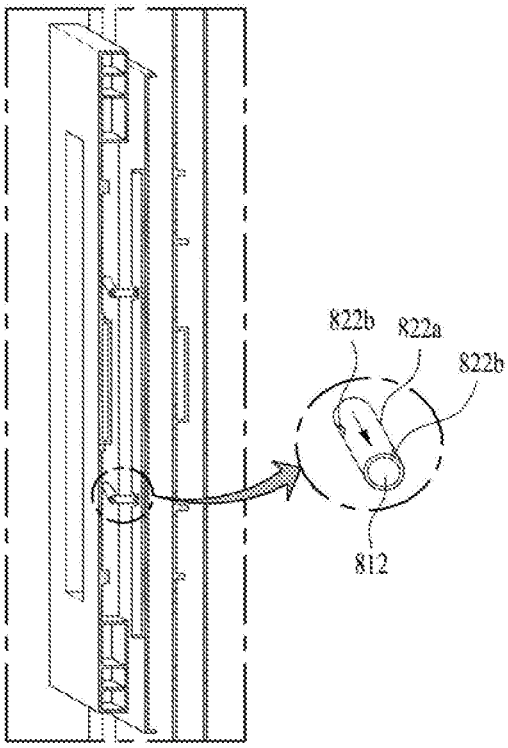
FIG. 7B illustrates the position change part of FIG. 7A according to an embodiment of the present disclosure.
Figure 7C:
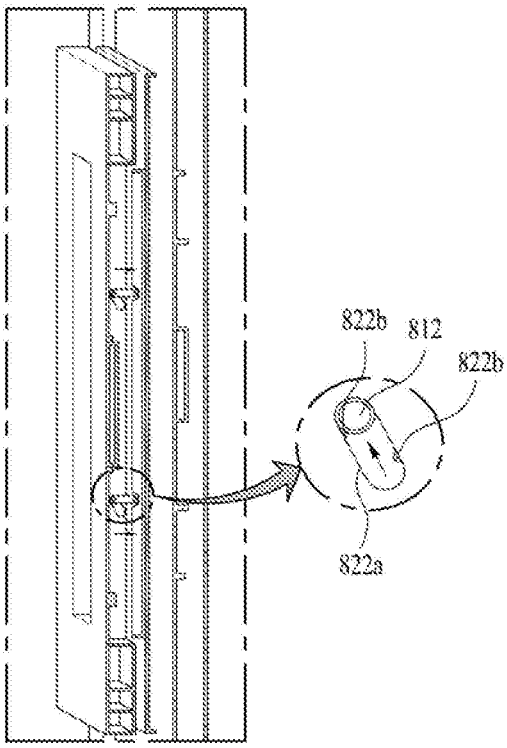
FIG. 7C illustrates the position change part of FIG. 7A according to an embodiment of the present disclosure.

FIGS. 7A-7C show another example of the body moving part according to an embodiment of the present disclosure.

Referring to FIG. 7A, the body coupling part 811 may be fixed to the fixing hinge 900. That is, the extension part 811 may be fixed to the fixing bar 910, and thus may be prevented from rotating.

The body moving part 820 may be arranged inside the pressing body 610 to allow the pressing body 610 to slidably move on the body coupling part 810. The body moving part 820 may comprise a sliding part 822 provided to the body fixing part 813 to allow the coupling hook 812 to move.

The body fixing part 813 may be coupled to the pressing body 610, and the sliding part 822 may also be coupled to the pressing body 610. Accordingly, the pressing body 610 may move integrally with the sliding part 822.

The sliding part 822 may comprise a sliding groove 822*a* extending from the body fixing part 813 to allow the coupling hook to reciprocate therethrough. The sliding groove 822*a* may be inclined to allow the pressing body to press the support part 540 by moving upward or downward.

Thus, when the fixing bar 910 on both sides is fastened to the fastening part 920 on both sides, the pressing body 610 may move as the sliding groove 822*a* moves along the coupling hook 812.

When the sliding groove 822*a* is inclined such that the upper end of the sliding groove 822*a* is closer to the fixing hinge 900 than the lower end of the sliding groove 822*a*, the pressing body 610 may press the support part 540 by moving upward.

As shown in the figures, when the sliding groove 822*a* is inclined such that the upper end of the sliding groove 822*a* is farther from the fixing hinge 900 than the lower end of the sliding groove 822*a*, the pressing body 610 may press the support part 540 by moving downward.

Accordingly, the pressing body 610 may easily and evenly press the surface of the laundry P while being positioned parallel to the support part 540 even when a complex element such as the radial rotation part 821 is not provided to the fixing bar 910.

The body moving part 820 may comprise a stopper 822*b* protruding from an inner circumferential surface of the sliding groove 822*a* so as to fix the position of the coupling hook 812 at one end or both ends of the sliding groove 822*a*.

A plurality of stoppers 822*b* may be provided such that the coupling hook 812 may be fixed to the upper end and the lower end of the sliding groove 822*a*, respectively. The stoppers 822*b* may protrude inward from the sliding groove 822*a*.

Thereby, the pressing body 610 may be prevented from arbitrarily moving on the support part 540. Further, the position of the pressing body 610 may be fixed even when vibration of the laundry treating apparatus is transmitted to the pressing body 610. In addition, the pressing body 610 may be prevented from moving downward by the weight of the pressing body 610.

The protruding surface of the stopper 822*b* may be formed as a curved surface. Thus, when external force directed to the upper or lower side is applied to the pressing body 610, the coupling hook 812 may easily pass through the stopper 822*b*.

As a result, the user may completely open the pressing body 610 from the support part 540 to mount part the laundry on the support part 540. In addition, the pressing body 610 may be positioned spaced apart from the support part 540 by a predetermined distance, then may be brought into uniform contact with the surface of the laundry.

Figure 8A:
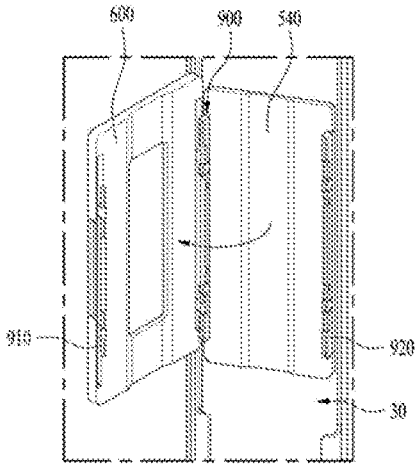
FIG. 8A illustrates a structure allowing the pressing part to rotate to both sides of a support part according to an embodiment of the present disclosure.
Figure 8B:
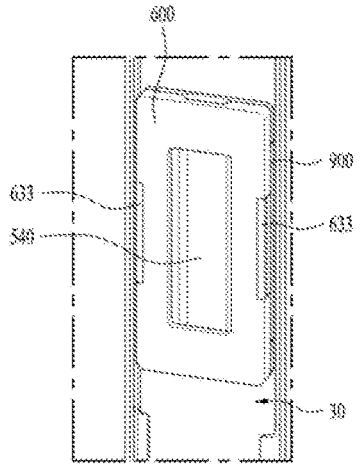
FIG. 8B illustrates the structure of FIG. 8A according to an embodiment of the present disclosure.
Figure 8C:
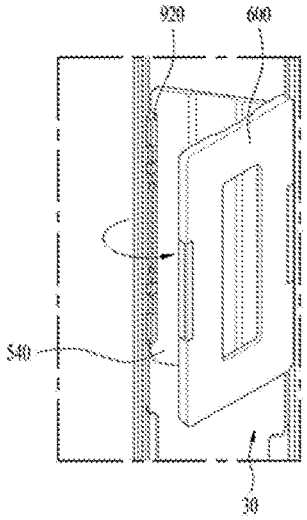
FIG. 8C illustrates the structure of FIG. 8A according to an embodiment of the present disclosure.

FIGS. 8A-8C show a structure allowing the pressing body to open the support part to both sides.

Referring to FIG. 8B, the pressing body 610 may remain fixed to the support part 540 by the fixing hinge 900.

As described above, the fixing hinge 900 may be provided on both sides of the pressing body such that one surface of the pressing body 610 is pressed while maintaining a distance from the support part 540. The fixing bar 910 may be provided on both sides of the pressing body, and a plurality of fastening parts 920 may be provided to the support part or the door so as to be coupled to the fixing bar.

In this case, each of the fastening parts may be detachably provided to each of the fixing bars.

Referring to FIG. 8A, the user may rotate the pressing body 610 by separating the fixing bar 910 and the fastening part 920 on one side. In addition, referring to FIG. 8C, the user may rotate the pressing body 610 by separating the fixing bar 910 and the fastening part 920 from the opposite side.

Thus, the user may rotate the pressing body 610 in a desired direction according to the state of the laundry P or the place where the laundry treating apparatus is disposed.

When the fastening part 920 and the fixing bar 910 on one side are separated, and the fastening part 920 and the fixing bar 910 on the opposite side are also separated, the pressing body 610 may be completely separated from the door 30. At this time, the user may be injured as the pressing body 610 falls, and it may be cumbersome to re-couple the pressing body 610.

Therefore, the pressing body 610 may need to be kept coupled to the door 30 even when each fixing bar 910 is detachably provided to the corresponding fastening part 920.

To this end, the fixing hinge 900 of the laundry treating apparatus 100 may be configured to allow the fixing bar 910 to be separated from the fastening part 920 when the pressing body 610 is arranged to face the support part 540, and to prevent the fixing bar 910 from being separated from the fastening part 920 when the pressing body 610 rotates away from the support part.

Both sides of the pressing body 610 may be provided with a handle 633 allowing the user to control the fixing hinge 900. Details will be described later.

Figure 9A:
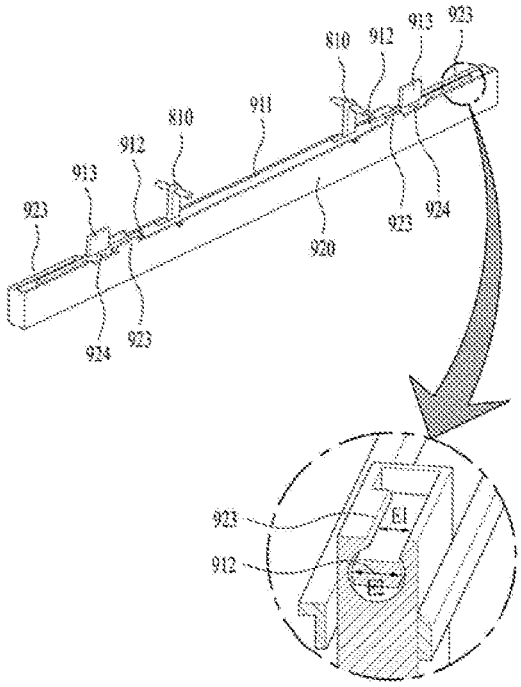
FIG. 9A illustrates an example of a fixing hinge capable of fixing the pressing part while allowing the pressing part to rotate to both sides according to an embodiment of the present disclosure.
Figure 9B:
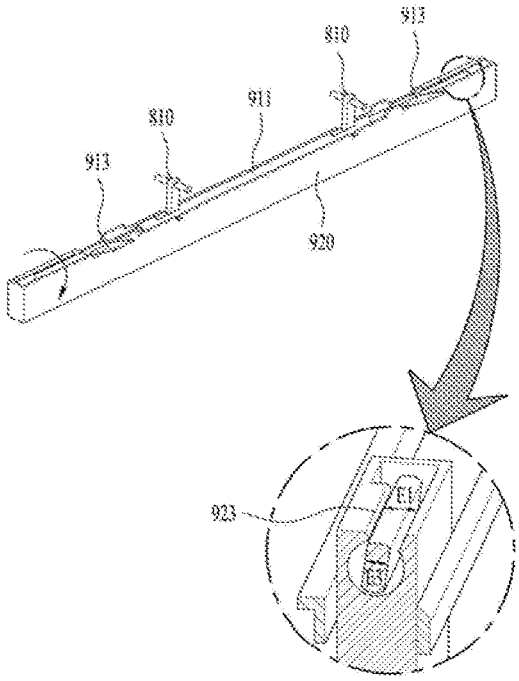
FIG. 9B illustrates the fixing hinge of FIG. 9A according to an embodiment of the present disclosure.

FIGS. 9A-9B show an example of the fixing hinge 900.

Referring to FIG. 9A, the fixing bar 910 may be accommodated in and fixed to the fastening part 920.

The fixing body 911 may be provided as an element separate from the step body 912 and may be coupled to the step body 912. That is, the step body 912 may be coupled to the fixing body 911 so as to rotate in an axial direction. That is, the step body 912 may be provided as a member separate from the fixing body 911, and may be arranged in the fixing body 911 so as to arbitrarily rotate.

The catching part 923 may be provided only in an area where the step body 912 is arranged, and may not be provided in an area where the fixing body 911 is arranged.

The fixing bar 910 may further comprise a release rib 913 protruding in a radial direction of the fixing bar 910. When the release rib 913 extends from the step body 912 and external force is applied thereto, the step body 912 may be rotated in the fixing body 911.

The greatest thickness E2 of the step body 912 may be greater than the distance E1 between the catching part 923 and the fastening groove 922. However, the least thickness E3 of the step body 912 may be less than the distance E1.

Accordingly, when separate external force is not applied to the fixing bar 910, the step body 912 may be prevented from being separated from the catching part 923, and the fixing bar 910 may remain fixed to the fastening part 920.

Referring to FIG. 9B, when the release rib 913 rotates, the step body 912 may rotate according to rotation of the release rib 913. Thereby, the least thickness E3 of the step body 912 may be aligned with the distance E1, and the step body 912 may be separated without contacting the catching part 923.

As a result, only the fixing bar 910 on which the release rib 913 rotates may be separated from the fastening part 920, and the fixing bar 910 on which the release rib 913 does not rotate may remain fixed to the fastening part 920.

The fixing bar 910 may further comprise an elastic part configured to return the release rib 913 to the original position to return the step body 912 to the original position when the external force is removed from the release rib 913.

The elastic part may be provided as a spring provided to portions of the fixing body 911 and the step body 912 connected to each other.

Figure 10:
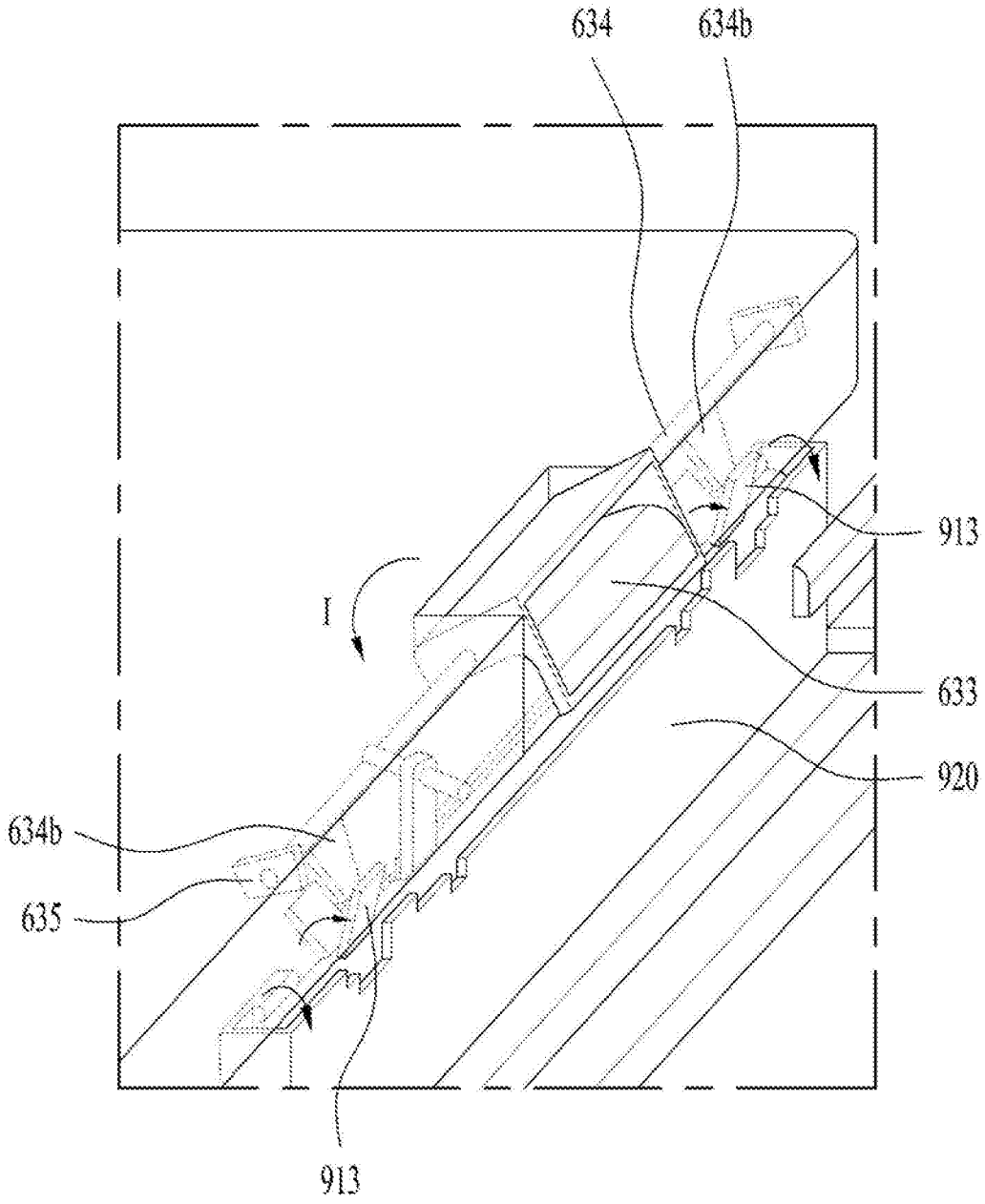
FIG. 10 illustrates a structure for separating the fixing hinge of FIG. 9 according to an embodiment of the present disclosure.

FIG. 10 shows the structure of a rotatable installation part for rotating the release rib.

Referring to FIG. 10, the rotatable installation part 630 may comprise a handle groove 634 provided in the pressing body 610 to insert the handle thereinto. The handle body 633 may be disposed in the handle groove.

The rotatable installation part 630 may comprise a handle body 633 rotatably provided to the pressing body 610, a handle rotation pin 634 configured to rotatably couple the handle body to the pressing body 610, a pin fixing part 635 provided to both ends of the handle rotation pin 634 to allow the handle rotation pin 634 to rotate in the pressing body 610, and a rib contact bar 634*b* extending from the handle rotation pin to press the release rib.

The rib contact bar 634*b* may be provided to the handle rotation pin 634 such that the rib contact bar 634*b* remains spaced apart from the release rib 913 when no external force acts on the handle body 633, and may press the release rib 913 when external force acts on the handle body 633.

Accordingly, when the handle body 633 rotates, only the fixing bar 910 having the release rib 913 rotated by the handle body 633 may be separated from the fastening part 920. On the contrary, since the release rib 913 of the fixing bar 910 provided on the opposite side may not rotate, and thus the step body 912 may remain fastened to the catching part 923.

That is, the release rib 913 may be configured to rotate when the release rib 913 is pressed by the handle 633 provided to the pressing body 610. Thus, only the fixing bar 910 to which external force is transmitted by the handle 633 may be separated from the fastening part 920, and the other fixing bar 910 may remain fixed to the fastening part 920.

Figure 11A:
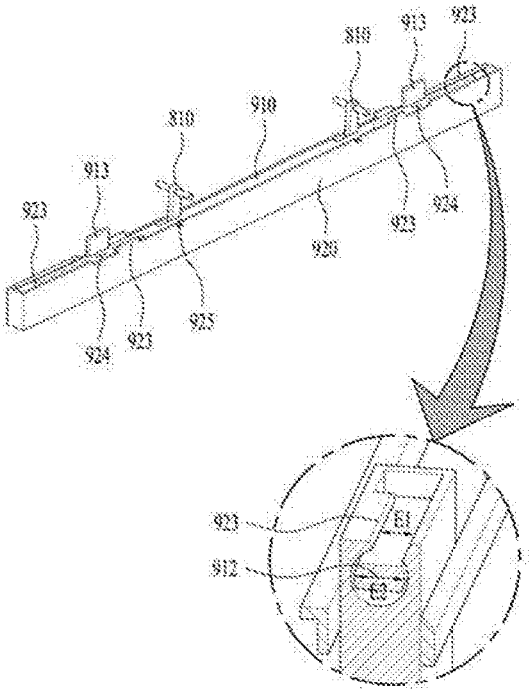
FIG. 11A shows another example of the fixing hinge that may be fixed to the pressing part while rotating the pressing part on both sides according to an embodiment of the present disclosure.
Figure 11B:
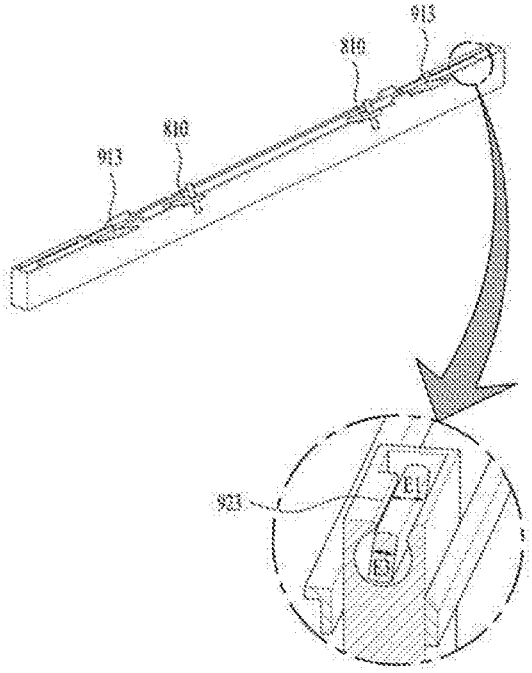
FIG. 11B shows the fixing hinge of FIG. 11A according to an embodiment of the present disclosure.

FIGS. 11A-11B show another example of the fixing hinge 900 according to an embodiment of the present disclosure.

Unlike the fixing hinge 900 of FIGS. 9A-9B, the fixing hinge 900 of FIGS. 11A-11B may be integrated with the step body 912. That is, the step body 912 may be arranged to rotate together with the fixing body 911, and the release rib 913 may extend from the step body 912 or the fixing body 911.

FIG. 11A illustrates a case where the pressing body 910 rotates and the fixing bar 910 on one side forms a center of rotation of the pressing body 610.

Referring to FIG. 11A, the fixing body 911 and the step body 912 may be accommodated in and coupled to the fastening part 920 together. In this case, the thickness E2 of the step body 912 may be aligned with the distance E1 between the catching part 923 and the fastening groove 922.

FIG. 11B shows arrangement of the fixing bars 920 on both sides when the pressing body 610 and the support part 540 are arranged parallel to each other.

Referring to FIG. 11B, when the pressing body 610 is rotated to face the support part 540, the fixing body 911 and the step body 912 may be rotated at the same time. Thereby, the release rib 913 may also be rotated. As a result, the smaller thickness E3 of the step body 912 may be aligned with the distance E1, and the fixing bar 910 may be arranged to be separated from the fastening part 910.

Thus, when the pressing body 610 is arranged parallel to the support part 540, the fixing bars 910 on both sides may be arranged to be separated from the fastening part 920 at any time. However, when the pressing body 610 starts to rotate to any one of the sides of the support part 540, the fixing bar 910 which becomes the center of the rotation may be prevented from being separated from the fastening part 920.

The fastening part 920 may further comprise a rib seating groove 924 concavely formed in the inner circumferential surface of the fastening groove 922 to allow the release rib 913 to be seated thereon, and a coupling seating groove 925 concavely formed in the inner circumferential surface of the coupling groove 922 to allow the body coupling part 810 to be seated thereon.

Figure 12A:
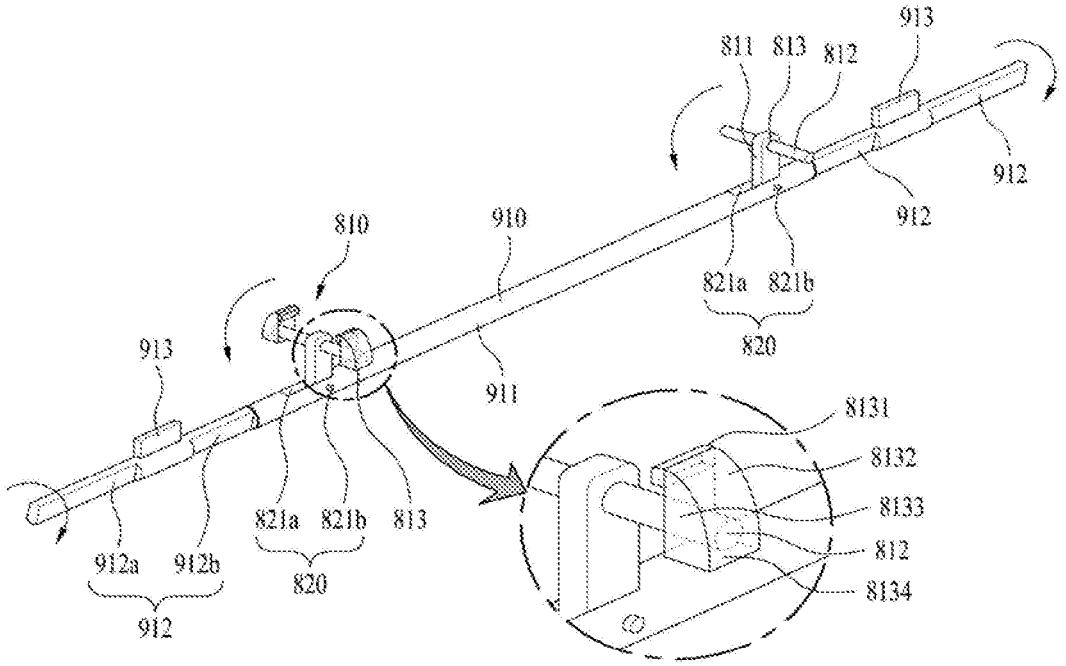
FIG. 12A illustrates a structure for separating the fixing hinge of FIG. 11 according to an embodiment of the present disclosure.
Figure 12B:
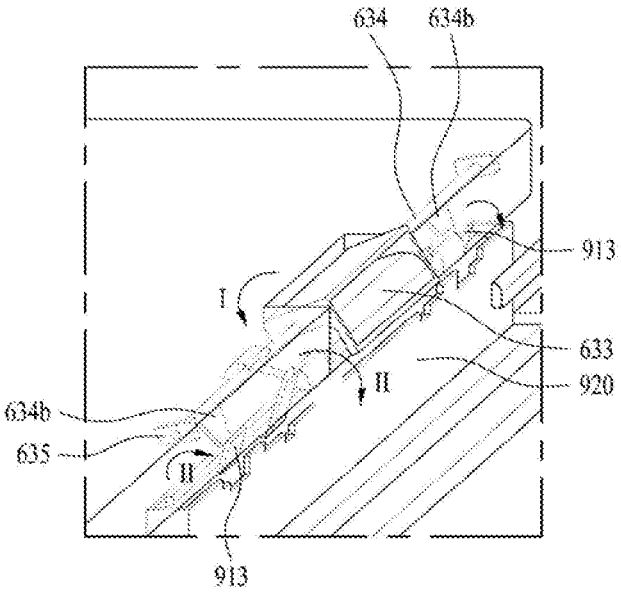
FIG. 12B illustrates the structure of FIG. 12A according to an embodiment of the present disclosure.
Figure 12C:
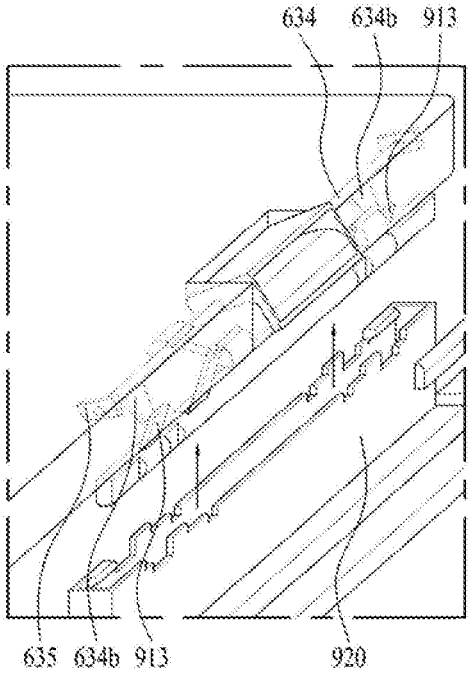
FIG. 12C illustrates the structure of FIG. 12A according to an embodiment of the present disclosure.

FIGS. 12A-12C illustrate a structure for opening the fixing hinge of FIGS. 11A-11B.

Referring to FIG. 12A, the body fixing part 813 may comprise a rotation bar 8132 provided inside the pressing body to guide movement of the free end of the coupling hook 832, a fixing rib 8133 provided on both sides of the rotation bar to guide movement of the rotation bar, an anti-separation part 8131 provided to one end of the rotation bar to prevent the coupling hook from being separated, and a stop rib 8134 provided to an opposite end of the rotation bar to limit movement of the coupling hook.

The rotation bar 8132 may provide a space in which the coupling hook 812 may rotate as the fixing bar 910 rotates in the pressing body 610. In addition, the rotation bar 8132 may have a shape corresponding to the trajectory of the free end of the coupling hook 812 created when the coupling hook 812 is rotated.

The fixing rib 8133 may be provided to both sides of the rotation bar to accommodate the coupling hook 812.

The anti-separation part 8131 may prevent the coupling hook 812 from excessively rotating as to be separated from the body fixing part 813. The anti-separation part 8131 may be formed in a rib shape and may extend or protrude from one end of the rotation bar 8132 toward the coupling hook 812.

The stop rib 8134 may be arranged to support the lower end of the coupling hook 812 to support the weight of the fixing bar 910 when the pressing body 610 is opened.

A plurality of body fixing parts 813 may be provided, and may be arranged to be coupled to all the plurality of coupling hooks 812.

Referring to FIG. 12B, the fixing bar 910 may be fixed to the fastening part 920.

At this time, when the user rotates the handle body 633 by hand in direction I, the handle rotation pin 634 connected to the handle body 633 may be rotated, and the rib contact bar 634*b* integrally extending from the handle rotation pin 634 may rotate in direction II.

Accordingly, the rib contact bar 634*b* may rotate the release rib 913 in direction II and also rotate the fixing bar 910 in direction II. As a result, the wide side of the step body 912 may face the catching part 923 provided in the fastening part 920.

Referring to FIG. 12C, when the user applies external force in a direction in which the pressing body 610 is spaced apart from the support part 540, the step body 912 may be separated from the catching part 923. Thus, the fixing bar 910 may be separated from the fastening part 920.

At this time, the narrow side of the step body 912 of the fixing bar 910 on the opposite side will face the catching part 923 according to rotation of the fixing bar 910. Thus, the fixing bar 910 on the opposite side may remain fixed to the fastening part 920 and serve as a center of rotation of the pressing body 610.

Figure 13A:
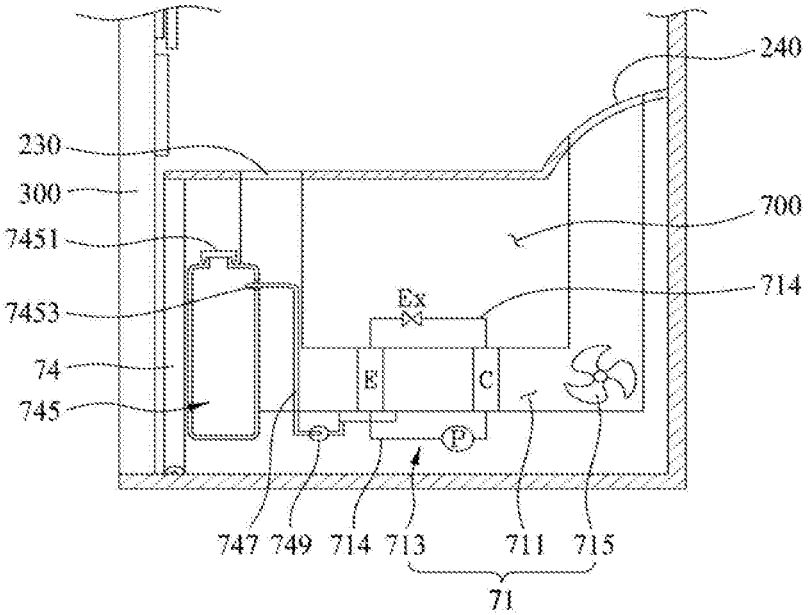
FIG. 13A illustrates a structure of a supply part of the laundry treating apparatus according to an embodiment of the present disclosure.

Hereinafter, the structure of the supply part 700 of the laundry treating apparatus of the present disclosure will be described with reference to FIGS. 13A-13B.

The supply part 700 may comprise at least one of an air supply 71 configured to supply air (heated air or unheated air) to the accommodation space 220, or a moisture supply 72 configured to supply moisture (steam or mist) to the accommodation space 220.

The air in the accommodation space 220 may be circulated through the supply part 700. To this end, the inner body 210 may comprise a discharge port 250 allowing air to be discharged to the supply part 700 therethrough, a suction port 240 allowing air to be supplied from the supply part 700 therethrough, and a steam port 250 allowing moisture or steam to be supplied from the supply part 700 therethrough.

Since the supply part 700 generates hot air having a lower density than air, the supply part 700 may be arranged at a lower portion of the inner case 200 such that the hot air may be completely supplied to the accommodation space 220.

The supply part may comprise at least one of an air supply 71 configured to supply air (heated air or unheated air) to the accommodation space 220, or a moisture supply 72 configured to supply moisture (steam or mist) to the accommodation space 220.

Hereinafter, for simplicity, description will be given on the assumption that the supply part comprises both the air supply 71 and the water supply part 72, wherein the air supply 71 supplies hot air to the accommodation space 220, and the moisture supply 72 supplies steam to the accommodation space 220.

The air supply 71 may comprise a circulation duct 711 allowing air in the accommodation space 220 to circulate therethrough, a heat exchanger 713 configured to exchange heat with air flowing along the circulation duct 711, and a blower 715 allowing the air in the accommodation space 220 to flow along the circulation duct 711.

The circulation duct 711 may communicate with the accommodation space 220 through the air discharge port 250 and the air suction port 230 provided in the accommodation space 220.

The air discharge port 250 and the air suction port 36 may be formed through the bottom surface of the accommodation space 220 in a penetrating manner to allow the accommodation space 220 to communicate with the supply part 700. Accordingly, when one end of the circulation duct 711 provided inside the supply part 700 is connected to the air suction port 230 and the opposite end of the circulation duct 711 is connected to the air discharge port 250, the circulation duct 711 may communicate with the accommodation space 220.

The heat exchanger 713 may serve to dehumidify and heat the air introduced into the circulation duct 711. FIGS. 13A-13B show a heat pump as an example of the heat exchanger.

When the heat exchanger is provided as a heat pump, the heat exchanger 713 may include an evaporator E provided in the circulation duct 711, a condenser C located in the circulation duct 711, and a compressor P and an expander Ex located outside the circulation duct.

The evaporator E, the compressor P, the condenser C and the expander Ex may be connected to each other through a refrigerant pipe 714.

The compressor P may serve to compress a refrigerant at a high pressure such that the refrigerant may circulate along the refrigerant pipe 714. The evaporator E may serve to evaporate the refrigerant by absorbing heat from the air inside the circulation duct 711. The condenser C may serve to condense the refrigerant by releasing heat into the air inside the circulation duct 711.

The blower 715 may be located inside the circulation duct 711 to allow air in the accommodation space 220 to circulate through the circulation duct 711. The blower 715 may be arranged between the condenser C and the air discharge port 240.

Accordingly, when the blower 715 is operated, the air inside the circulation duct 711 may move to the accommodation space 220 through the air discharge port 240, and the air inside the accommodation space 220 may move to the circulation duct 711 through the air suction port 230.

The air introduced into the circulation duct 711 through the air suction port 230 may be cooled while passing through the evaporator E, and the air having passed through the evaporator E may be heated while passing through the condenser C.

When the air is cooled by passing through the evaporator E, moisture contained in the air may be removed (i.e., the air is dehumidified). The moisture removed from the air (i.e., condensed water) may remain on the surface of the evaporator or inside the circulation duct.

The condensed water remaining in the circulation duct 711 may lower the heat exchange efficiency of the heat exchanger 713. Accordingly, the present disclosure may further comprise a drainage part configured to remove the condensed water produced by the evaporator E.

The drainage part may comprise a drain tank 745 detachably provided to a machine room door 74, and a drain pipe 747 and a drain pump 749 configured to supply condensed water from the circulation duct 711 to the drain tank 745.

The drain tank 745 may be provided in any shape as long as it is capable of providing a space to store the liquid. The drain tank 745 may include a drain tank lid 7451 configured to drain the stored liquid from the drain tank 745, and an introduction port 7453 to which the drain pipe 747 is detachably connected.

The introduction port 7453 may be provided with a check valve (not shown). This may be intended to allow the drain pipe 747 to be separated from the introduction port 7453 when the machine room door 74 opens the supply part 700 and allow the drain pipe 747 to be inserted into the introduction port 7453 when the machine room door 74 closes the supply part 700 (and also to prevent water in the drain tank from leaking out of the drain tank when the drain tank is separated from the machine room door).

Figure 13B:
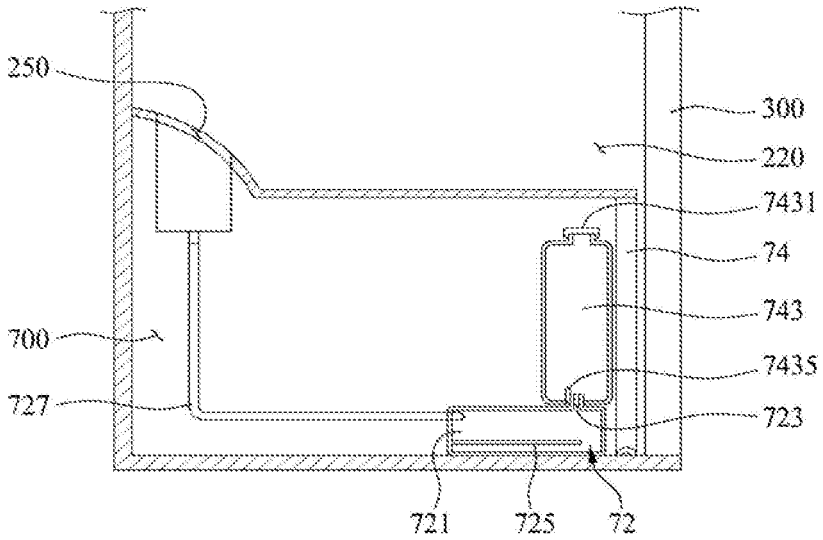
FIG. 13B illustrates the structure of FIG. 13A according to an embodiment of the present disclosure.

As shown in FIG. 13B, the moisture supply 72 may comprise a storage 721 provided in the supply part 700, a heater 725 provided in the storage 721, and a moisture supply pipe 727 arranged to connect the storage 721 to a moisture discharge part 250.

The storage 721 may serve to store water, and the heater 725 may serve to heat the water stored in the storage 721 to transform the water into steam. The moisture supply pipe 727 may serve to guide the steam from the storage 721 to the accommodation space 220.

Accordingly, the heater 725 may be arranged to be adjacent to the bottom surface of the storage 721, and the moisture supply pipe 727 may be disposed on the top surface (or upper end) of the storage 721.

The storage 721 may receive water through a water supply. The water supply may be provided as a water supply tank 743 detachably provided to the machine room door 74.

In this case, the storage 721 may further comprise a connection pipe 723 which is connected to the water supply tank 743 when the machine room door 74 closes the supply part 700, and is separated from the water supply tank 743 when the machine room door 74 opens the supply part 700.

The water supply tank 743 may be formed in any shape as long as the liquid may be stored therein. The water supply tank 743 may comprise a water supply tank lid 7431 provided to supply a liquid into the water supply tank 743, a discharge port (not shown) into which the connection pipe 723 is inserted, and a check valve 7435 provided to the discharge port.

The water supply tank 743 may be detachably provided to the machine room door 74 in consideration of a case where the laundry treating apparatus 100 is installed at a location far from a water supply source (not shown).

That is, when the laundry treating apparatus 100 is disposed at a location adjacent to the water supply source, the storage 721 may be controlled to receive water from the water supply source when necessary. However, when the laundry treating apparatus 100 is installed at a location far from the water supply source, the above-described control operation may not be allowed. The water supply tank 743 is a means to address such an issue.

Accordingly, unlike the conventional laundry treating apparatus which removes odors or wrinkles by supplying hot air or steam to a rotating drum, the laundry treating apparatus according to the present disclosure may supply hot air and steam with the laundry kept straightened in the accommodation space 220. Therefore, wrinkles may be prevented from being formed on the laundry after supply of steam or hot air is completed.

As apparent from the above description, the present disclosure has effects as follows.

According to the present disclosure, a laundry treating apparatus may prevent clothing from being disorderly arranged or the position or shape thereof from being changed in the process of pressing the clothing.

According to the present disclosure, a laundry treating apparatus may evenly press the surface of clothing by applying pressure to the front of the clothing.

According to the present disclosure, a laundry treating apparatus may have a pressing part configured to press clothing and capable of slidably moving toward the front of the clothing while rotating on one surface on which the clothing is placed.

According to the present disclosure, a laundry treating apparatus may evenly press the surface of clothing while a pressing part moves up or down.

According to the present disclosure, a laundry treating apparatus may maximize user convenience by allowing a pressing part configured to press clothing to selectively rotating to both sides.

According to the present disclosure, a laundry treating apparatus may prevent a pressing part configured to press clothing from being completely separated while rotating and moving.

It will be apparent to those skilled in the art that various modifications and variations can be made in the present disclosure without departing from the spirit and scope of the disclosure. Thus, it is intended that the present disclosure cover the modifications and variations of this disclosure provided they come within the scope of the appended claims and their equivalents.

What is claimed is:

1. A laundry treating apparatus comprising:

a cabinet comprising an opening;

a door rotatably coupled to the cabinet and configured to open and close the opening;

an inner case disposed in the cabinet and configured to provide an accommodation space to accommodate laundry;

a supply part configured to communicate with the inner case to supply at least one of air or moisture to the accommodation space; and a mount part disposed on at least one of the inner case or the door and configured to place the laundry in the accommodation space, wherein the mount part comprises:

a support part disposed on at least one of the inner case or the door to support a surface of the laundry; and a pressing part configured to rotate toward the support part, and wherein the pressing part comprises:

a pressing body rotatably coupled to one of the inner case, the door, or the support part;

a fixing hinge disposed on one of the inner case, the door, or the support part, the fixing hinge being configured to rotate the pressing body to a position where the pressing body faces the support part while being spaced apart from the support part; and a position change part configured to move the pressing body toward the support part when the pressing body is positioned facing the support part.

2. The laundry treating apparatus of claim 1, wherein the position change part is coupled to the fixing hinge to move the pressing body toward the support part when the pressing body is positioned facing the support part.

3. The laundry treating apparatus of claim 2, wherein the position change part further comprises:

a body coupling part connected to the fixing hinge and coupled to the pressing body; and a body moving part coupled to the body coupling part and configured to move the pressing body toward the support part or move the pressing body and the body coupling part toward the support part simultaneously.

4. The laundry treating apparatus of claim 3, wherein the body moving part comprises:

a radial rotation part coupled to the fixing hinge and configured to rotate the body coupling part in a direction parallel to a height direction of the support part to move the pressing body toward the support part.

5. The laundry treating apparatus of claim 4, wherein the radial rotation part further comprises:

a movement groove formed in the fixing hinge in the height direction of the support part; and a rotation coupling pin coupled to one end of the movement groove and configured to rotatably couple to one end of the body coupling part.

6. The laundry treating apparatus of claim 3, wherein the body coupling part is fixed to the fixing hinge, and wherein the body moving part is arranged inside the pressing body and configured to allow the pressing body to slidably move on the body coupling part.

7. The laundry treating apparatus of claim 6, wherein the body coupling part further comprises:

an extension part extending from the fixing hinge;

a coupling hook protruding from one side or both sides of the extension part; and a body fixing part arranged inside the pressing body and coupled to the coupling hook, and wherein the body moving part further comprises:

a sliding part coupled to the body fixing part and configured to allow the coupling hook to move.

8. The laundry treating apparatus of claim 7, wherein the sliding part further comprises:

a sliding groove extending from the body fixing part configured to allow the coupling hook to reciprocate therethrough, wherein the sliding groove is inclined to allow the pressing body to press the support part by moving downward.

9. The laundry treating apparatus of claim 8, wherein the body moving part further comprises:

a stopper protruding from an inner circumferential surface of the sliding groove and configured to allow the coupling hook to remain fixed at one end or both ends of the sliding groove.

10. The laundry treating apparatus of claim 3, wherein the fixing hinge comprises:

a fixing bar connected to the body coupling part and configured to rotate the pressing body; and a fastening part rotatably coupled to the fixing bar on the door or the support part and configured to support the pressing body.

11. The laundry treating apparatus of claim 10, wherein the fixing hinge is disposed on both sides of the pressing body and configured to allow one surface of the pressing body to be pressed while maintaining a space between the one surface and the support part.

12. The laundry treating apparatus of claim 11, wherein the fixing bar is disposed on both sides of the pressing body, wherein the fastening part comprises a plurality of fastening parts coupled to the support part or the door, wherein each of the fastening parts is detachably coupled to each of the fixing bars.

13. The laundry treating apparatus of claim 12, wherein the fixing hinge is configured to:

allow the fixing bar to be separated from the fastening part when the pressing body is positioned facing the support part; and prevent the fixing bar from being separated from the fastening part when the pressing body is rotated away from the support part.

14. The laundry treating apparatus of claim 13, wherein the fastening part comprises:

a fastening body configured to accommodate the fixing bar;

a fastening groove configured to allow the fixing bar to be inserted into and withdrawn from the fastening body; and a catching part protruding from an inner circumferential surface of the fastening groove and configured to prevent the fixing bar from being separated, and wherein the fixing bar comprises:

a fixing body accommodated in the fastening body; and a step body coupled to the fixing body in a stepped manner and separable from the catching part.

15. The laundry treating apparatus of claim 14, wherein the fixing bar further comprises:

a release rib extending from the fixing body and configured to rotate the step body, and wherein the pressing body further comprises:

a rotatable installation part configured to press the release rib.

16. The laundry treating apparatus of claim 15, wherein the rotatable installation part comprises:

a handle body rotatably arranged in the pressing body;

a handle rotation pin configured to rotatably couple the handle body to the pressing body; and a rib contact bar extending from the handle rotation pin and configured to press the release rib.

17. The laundry treating apparatus of claim 15, wherein the step body is coupled to one or both ends of the fixed body and configured to axially rotate on the fixing body, and wherein the release rib extends from the step body.

18. The laundry treating apparatus of claim 15, wherein the step body, the fixing body, and the release rib are integrally formed, wherein the body coupling part comprises:

an extension part extending from the fixing hinge; and a coupling hook protruding from one side or both sides of the extension part, and wherein the pressing body further comprises:

a body fixing part coupled to the body coupling part and configured to allow the body coupling part to rotate in an axial direction of the fixing body.

19. The laundry treating apparatus of claim 18, wherein the body fixing part comprises:

a rotation bar disposed inside the pressing body and configured to guide movement of a free end of the coupling hook;

a fixing rib disposed on both sides of the rotation bar and configured to guide movement of the rotation bar;

an anti-separation part coupled to one end of the rotation bar and configured to prevent the coupling hook from being separated; and a stop rib coupled to an opposite end of the rotation bar and configured to limit movement of the coupling hook.

20. The laundry treating apparatus of claim 3, wherein the pressing body further comprises:

a rotatable installation part coupled to the fixing hinge, and wherein the rotatable installation part comprises:

an installation groove configured to allow the pressing body to move upward or downward on the fixing hinge, wherein the installation groove is longer than the fixing hinge.

* * * * *